United States Patent [19]

DeGennaro

[11] Patent Number: 4,633,235

[45] Date of Patent: Dec. 30, 1986

[54] OPTICAL CABLE SECURITY SYSTEM WITH STANDBY AND AUTOMATIC RE-ARMING FEATURES

[76] Inventor: Charles S. DeGennaro, 31 Pierce St., Hudson, Mass. 01749

[21] Appl. No.: 684,072

[22] Filed: Dec. 20, 1984

[51] Int. Cl.[4] ..... G08B 13/18

[52] U.S. Cl. ..... 340/568; 340/555; 340/636; 340/691

[58] Field of Search ..... 340/568, 555–557, 340/600, 636, 691

[56] References Cited

U.S. PATENT DOCUMENTS

| | | | |
|---|---|---|---|
| 3,235,738 | 2/1966 | Kress et al. . | |
| 3,278,923 | 10/1966 | Archer . | |
| 3,281,817 | 10/1966 | Archer . | |
| 3,329,946 | 7/1967 | Robbins . | |
| 3,444,547 | 5/1969 | Surek | 340/568 |
| 3,619,629 | 11/1971 | Matthews . | |
| 3,739,372 | 6/1973 | Schlisser et al. . | |
| 3,924,253 | 12/1975 | Marino . | |
| 3,948,582 | 4/1976 | Martin . | |
| 3,970,846 | 7/1976 | Schofield et al. . | |
| 4,010,458 | 3/1977 | Kopfli . | |
| 4,013,886 | 3/1977 | Schmid . | |
| 4,171,868 | 10/1979 | Stewart . | |
| 4,271,491 | 6/1981 | Simpson . | |
| 4,275,294 | 6/1981 | Davidson . | |
| 4,307,386 | 12/1981 | Bridge . | |
| 4,347,590 | 8/1982 | Heger et al. | 340/691 |
| 4,379,289 | 4/1983 | Peek | 340/555 |
| 4,419,658 | 12/1983 | Jarosz et al. | 340/636 |
| 4,465,998 | 8/1984 | Durand | 340/557 |
| 4,482,890 | 11/1984 | Forbes et al. | 340/557 |

OTHER PUBLICATIONS

Mt. West Alarm Catalog, p. 80, 1975, Phoenix, Ariz.

*Primary Examiner*—Glen R. Swann, III

*Attorney, Agent, or Firm*—Lahive & Cockfield

[57] ABSTRACT

A system for securing articles is disclosed including an optically transmissive, flexible cable capable of attachment to the articles and further consisting of links and separable connectors, the connectors joining the links together to permit optical transmissions therethrough; together with a transmitter connected to the cable, for transmitting optical pulses into the cable; a receiver also connected to the cable for receiving the pulses from said transmitter after passage through the cable; and control circuitry connected to the receiver for detecting perturbations in the received pulses and activating an indicator in response as well as for allowing stand-by operation wherein the indicator is disabled while one or more connectors are separated for authorized purposes and for re-arming the system following stand-by operation.

20 Claims, 6 Drawing Figures

TAMPER DETECTION CIRCUITRY, 32
FIBER CONDITION CIRCUITRY, 28
EMITTER, 24
RECEIVER, 26
OPTICAL CABLE, 14
BATTERY CONDITION CIRCUITRY, 34
ALARM & RELAY CIRCUITRY, 36
HALT CIRCUITRY, 30
TO CAMERA OR AUXILIARY SECURITY DEVICES
RELAY
ALARM
HALT
LOWBAT
LTAMPER
LFIBOPN
LIGHT
SAMCLK
SYSCLK
POWCLK
VDDEMIT
NC-SECURE N-OPEN
CLOSE-NO, ADD
OPEN-ADD

OPTICAL CABLE SECURITY SYSTEM WITH STANDBY AND AUTOMATIC RE-ARMING FEATURES

TECHNICAL FIELD

The technical field of this invention is security devices and, in particular, systems for securing articles employing optically transmissive flexible cables.

BACKGROUND OF THE INVENTION

At present, theft of merchandise in the United States is a problem of staggering dimensions. Retail stores of clothing, jewelry, and home furnishings must often resort to chaining or otherwise physically securing merchandise on display. Often measures for physically securing merchandise result in damage to the item, particularly when fragile articles are chained or otherwise attached to an immovable object. Locked items also present an inconvenience to the shopper and require that the store employ more saleshelpers. A similar problem is presented when goods are warehoused. Patrols by watchmen or surveillance with cameras greatly increases the cost of maintaining goods in storage.

A number of systems have been devised to secure articles of commerce, particulary retail merchandise. Electrical security devices have been devised wherein a circuit is maintained by a wire passing through the merchandise. However, electrical security systems suffer from a number of deficiencies. First, they are bulky and limited in the amount of merchandise that can be secured by the resistance of the electrical wires and the voltages that can be safely used in any device that may come in contact with consumers. Electrical systems are also typically unsuitable for outdoor applications because moisture will cause corrosion of connectors and thus intermittent failures. Additionally, thieves can easily tamper with such systems by short-circuiting with pins or splices the link that passes through a particular piece of merchandise which is sought. Moreover, electrical security devices can be prone to operating difficulties when located near high voltage lines or other voltage sources or radiowave generators. The electrical security devices, themselves, also can interfere with other electrical devices present in the store.

Another approach to securing merchandise, particularly in retail stores, has been to tag each individual item of merchandise with a device which is capable of disrupting or otherwise changing an electromagnetic field or signal. Typically, these devices take the form of integrated circuit patterns which are attached to each item and removed subsequent to purchase. If a thief attempts to remove an item from the store with the tag intact, passage through a detector, which typically generates a characteristic magnetic, microwave or radio field, will cause an alarm to be triggered. Unfortunately, these triggering devices do not reduce significantly the labor force needed to maintain a retail store. Triggers must be attached to each item and subsequently removed. Additionally, the electromagnetic fields generated by the detectors can be harmful to some customers, for example, individuals with implanted cardiac pacemakers. Moreover, the attachment of the devices can sometimes lead to damaged merchandise and a thief can circumvent the system by either removing the trigger device himself or herself, or otherwise shielding it prior to passing through the detector.

There exists a need for better security systems that are convenient and inexpensive, yet foolproof. Portable, reliable security systems which can operate, for example, on batteries while securing large enclosures would satisfy a long-felt need in the industry. Moreover, security systems which are not labor intensive and not easily bypassed, would represent an improvement in this field.

SUMMARY OF THE INVENTION

A security system designed to quickly and reliably secure valuable commodities is disclosed consisting of a controller and a plurality of optically transmissive, flexible cable lengths secured together by connectors. A controller includes an optical pulse emitter connected to one end of the fiber cable and a receiver connected to the other. Additionally, the controller includes circuitry for monitoring the condition of the optics and for signalling an alarm or an auxiliary security device in response to tampering with the cable links or the controller, itself. Moreover, the controller includes circuitry which allows for stand-by operations so that cable connectors can be opened and merchandise removed. Preferably, the controller rearms itself after a stand-by period of predetermined length has expired. Moreover, in the preferred embodiment, the controller is portable (about 3 lbs. in weight) and operated by a primary or secondary battery with a built-in circuit for detecting low battery conditions.

In one illustrated embodiment, the cable consists of plastic fiber or glass links and snap-apart or screw connectors, which are optically transmissive at about 600–700 nanometers, preferably about 650–660 nanometers. The cable is employed in conjunction with a controller which includes a light-emitting diode and receiver which generate and detect, respectively, red light corresponding to the optimal transmission wavelength of the fiber cable. Moreover, the controller can be programmed for stand-by cycles of different lengths. Additionally, the controller includes a built-in relay which can be operated either together with an audible alarm or in lieu of an alarm to activate an automatic dialer, to signal security personnel, to call for police help, or to activate auxiliary security devices, such as cameras.

In another aspect of the invention, the controller includes circuitry for generating a second indicator or alarm in response to two operations: either a low battery condition or a standby condition (e.g., the system is disabled for authorized purposes). In one preferred embodiment, this second indicator is a softer intermittent audible alarm and the controller further includes circuitry which can be programmed to vary the duration and frequency of the softer alarm.

The invention will next be described in connection with certain preferred embodiments; however, it should be clear to those skilled in the art that various changes and modifications, additions and subtractions can be made without departing from the spirit or scope of the invention. For example, the invention can be powered by either batteries or appropriately transformed household current. The light emitting diode transmitter can be replaced by a laser diode. Other articles besides merchandise, such as doors and windows, can also be secured with the invention. Similarly, this invention can be used as a fire detection device, since the fire will melt the plastic optical fiber optic link. Although a ring or loop is described in detail, a single line ending in a reflective surface can be used instead with a beam splitting device to separate the returning signal for processing. Additionally, it should be clear that the electronic components can be rearranged or fabricated by different techniques, such as metal-oxide-semiconductor (MOS) techniques and can be formed on a single chip or wafer for compactness. Moreover, one or more devices according to the invention can be networked together under microprocessor control and certain functions performed by components of the controller can be replaced by microprocessor operations. As used herein, the term "optical" is intended to cover not only visible light but also the wider spectrum of radiation (e.g., infrared and ultraviolet light) which can be transmitted through flexible cables.

DETAILED DESCRIPTION

Figure 1:
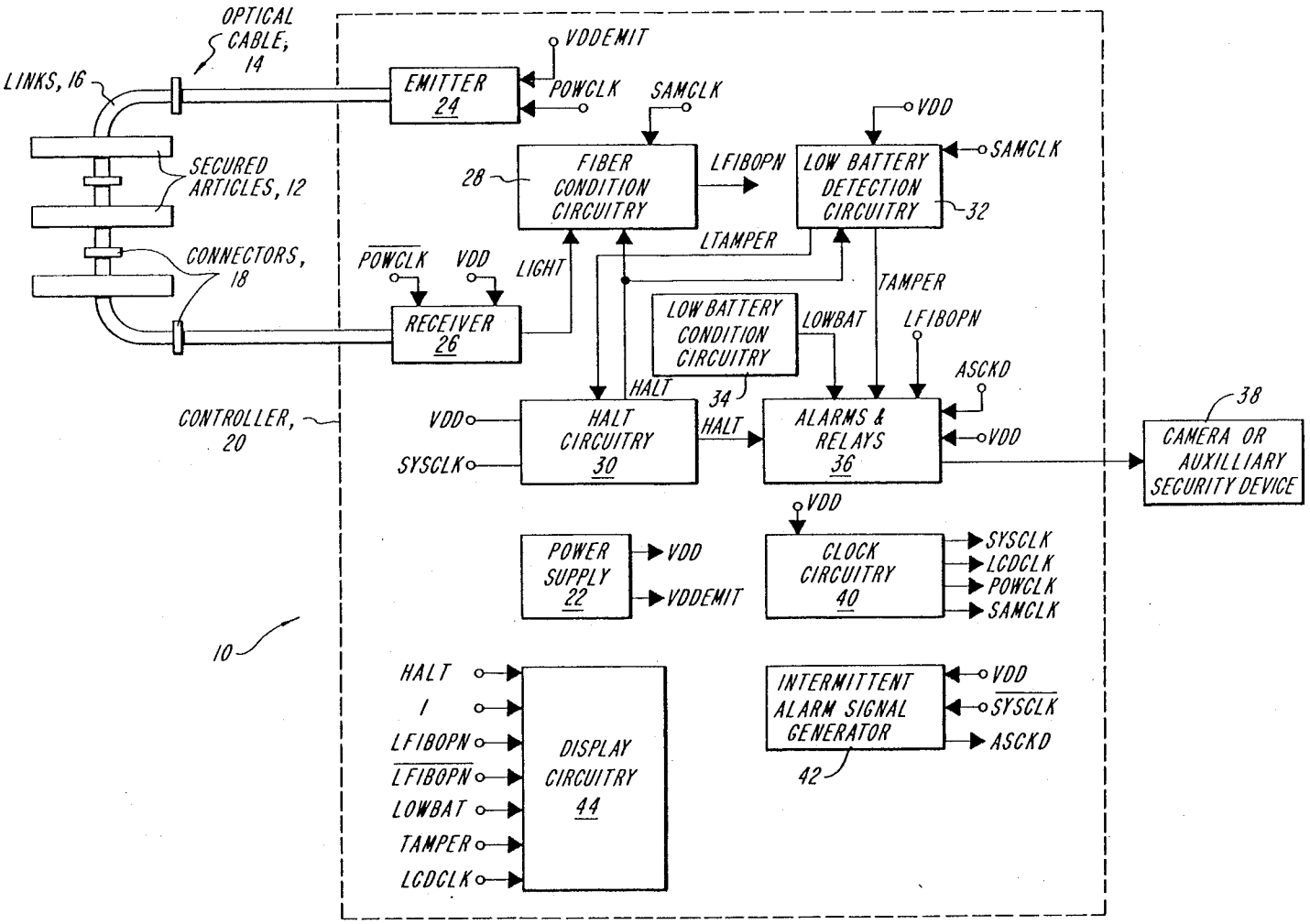
FIG. 1 is an overall block diagram of a controller and a linked fiber cable according to the invention.

FIG. 1 shows a security system 10 for securing articles 12 consisting of a controller 20, and a multi-link optical cable 14, which includes fiber links 16 and connectors 18. The fiber links 16 can be flexible plastic optical fibers (approximately 0.1 inch diameter) and the connectors 18 can be snap-apart connectors, both of which are commercially available. Also shown connected to the controller 20 is a camera or other conventional auxiliary security device 38. As shown, the optical cable 14 passes through a series of articles 12 which represent merchandise, inventory stock or other items to be secured. Also in FIG. 1, the principal components of the controller 20 are labelled and their relationship with each other depicted in block diagram form. An optical pulse emitted by emitter 24 passes via fiber links 16 and connectors 18 through the secured articles 12 and back to a receiver 26. The optical pulses are converted to electrical signals which are monitored by the fiber condition circuitry 28. If the halt circuitry 30 is not operating to created a stand-by condition, any disruption of the optical pulses received and monitored will result in the generation of an alarm signal by the fiber condition circuitry 28 and, consequently, the activation of alarm and relay 36. A secondary indicator signal is generated by the low battery condition circuitry 34 when the battery power is low, or by the halt circuitry 30 when the system is in a stand-by state. The alarm circuit 36 can respond to these indicator signals by producing a softer and intermittent alarm. Additionally, the halt circuitry 30 can also include circuitry to reactivate the system automatically after a pre-determined period of time.

The depiction of the controller 20 in this block diagram form is primarily for illustration. It should be clear to those skilled in the art that various component functions can be modified or rearranged. It should also be clear that the discrete components which are further depicted in the figures can be replaced by integrated circuits, employing MOS or related technologies, or a microprocessor control program.

Figure 2:
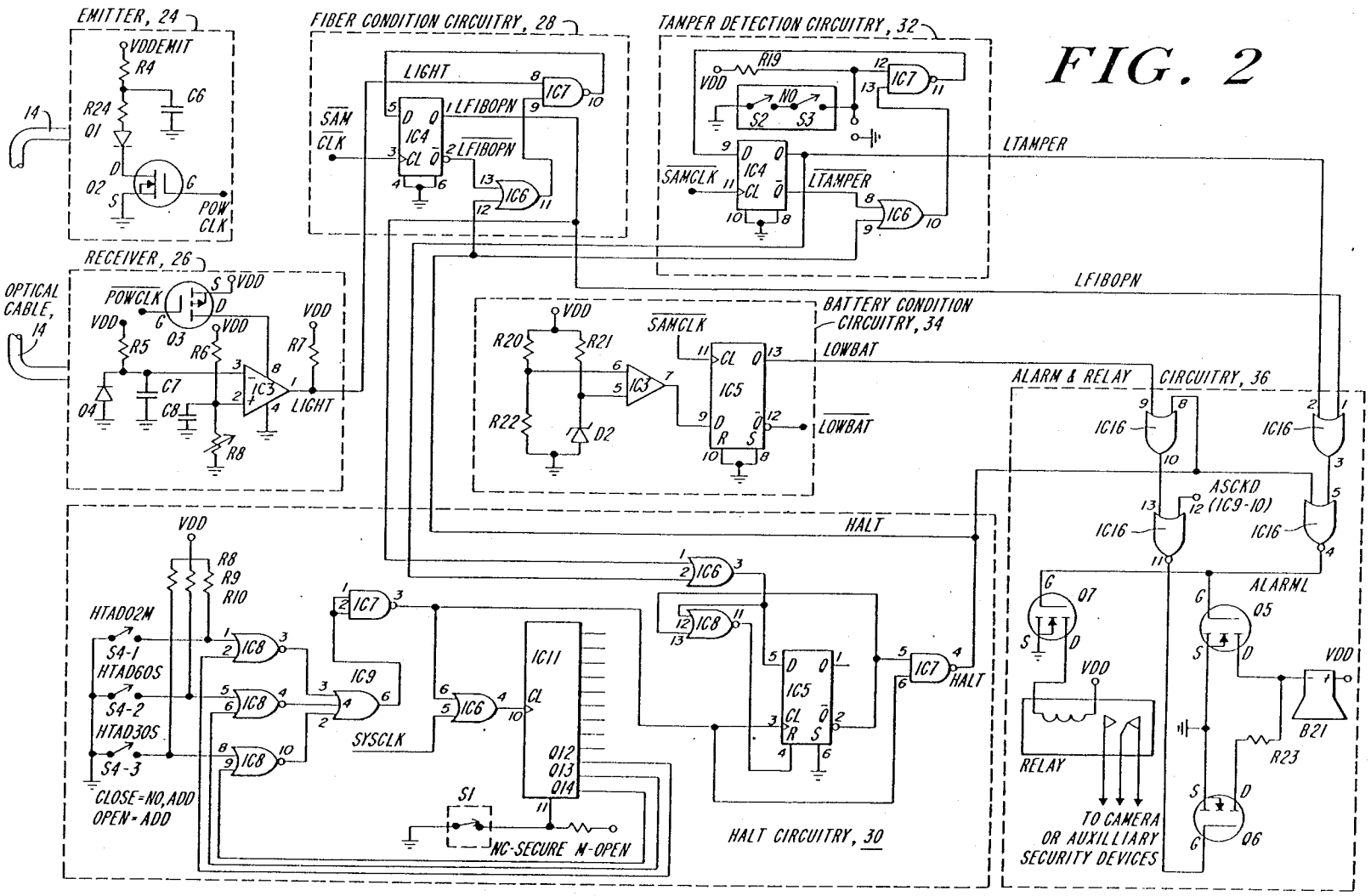
FIG. 2 is a detailed schematic diagram of the detection circuitry of the controller shown generally in FIG. 1.

In FIG. 2, more detailed schematic diagrams are presented for the detection-related components of the controller 20. FIG. 3–6 provides detailed schematic diagrams for the auxiliary components of the illustrated controller 20.

Figure 3:
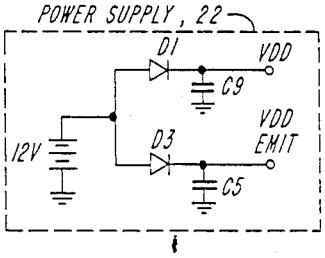
FIG. 3 is a detailed schematic diagram of the power supply, clock, intermittent alarm signal and display circuitry for the controller of FIG. 1.

The power supply circuit for the controller 20 is shown in FIG. 3 wherein a 12-volt battery is employed to generate a main system voltage, VDD, and a parallel voltage VDDEMIT which powers the emitter Q1. The separate voltage supply for the emitter is preferred to avoid power surges and interruptions in the detector circuitry as a result of optical pulse generation. The diodes shown in FIG. 3 isolate the two power circuits VDD and VDDEMIT from each other and form a protective circuit to assure that the circuitry of the controller 20 is not damaged in the event the battery is placed into its receptacle backwards.

Figure 4:
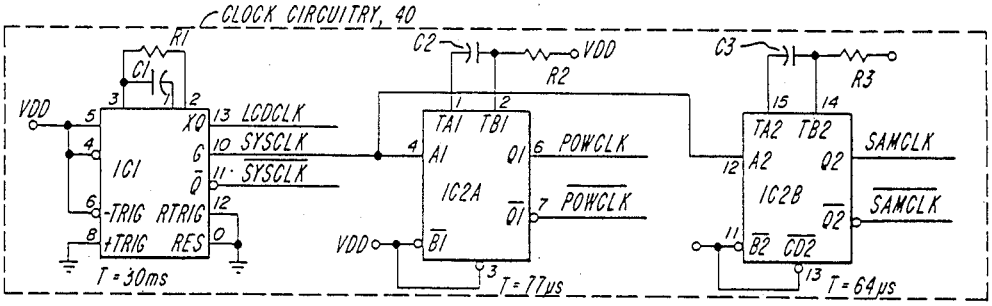
FIG. 4 is a detailed schematic diagram of the clock circuitry for the controller of FIG. 1.

The clock circuitry for the illustrated embodiment is shown in FIG. 4. As shown, integrated circuit IC1 generates a system clock signal having a period of about 30 milliseconds and a fifty percent duty cycle (and a LCD clock signal at double the frequency of the system clock). Integrated circuit **IC2*a* generates a power clock signal with an identical period and a pulse of 77 microseconds. The integrated circuit IC2*b* generates a sample clock signal, again with the same period but a pulse of 64 microseconds. These clock signals are used to drive the detection components as shown in more detail with reference to FIG. 2. The power clock signal is used to drive the emitter 24 and receiver 26, while the sample clock signal is employed by the fiber condition monitoring circuitry 28, the tamper detection circuitry 32, and the low battery condition circuitry 34. The system clock signal is used by the halt circuitry 30** as well as the intermittent alarm signal generator shown in FIG. 5. The LCD clock is used to drive the display circuitry shown in FIG. 6.

With reference again to FIG. 2, the principal components of the controller are discussed in more detail. The emitter 24 is powered by the parallel voltage source described above, VDDEMIT and the light-emitting diode, Q1, is driven by FET switch Q2 in response to the gated power clock signals. The receiver 26 includes a diode receiver Q4, the signal from which is amplified by OPAMP IC3, employing the FET switch Q3 which is gated by the inverse of the power clock, conserving power by shutting down amplifier IC3 except during the sampling period. Resistor R6 and variable resistor R8 form a voltage divider which can be set for the appropriate threshold detection. The resulting output of OPAMP IC3 is a signal, LIGHT, which is transmitted to the fiber condition monitoring circuitry 28. The fiber condition circuitry 28 will also receive a signal, HALT, from the halt circuitry 30 when the controller has been placed in the stand-by condition by an operator. As illustrated, the halt circuitry 30 further includes switches S4-1, S4-2, and S4-3 which allows the controller to be programmed for stand-by conditions of different durations. The stand-by condition is activated by the switch S1 which is normally closed in the operational mode. Preferably, the switch S1 can only be operated by insertion of the key and is designed to spring back to the secure position. As shown, the halt circuiry 30 employs the system clock to automatically rearm the controller even when switch S1 has been opened if a fiber link connector is not opened within a predetermined period of time. During standby operations the HALT signal is used to produce a visible display by the display circuitry 44 as well as produce a soft intermittent alarm in alarm circuitry 36.

The fiber monitor circuitry 28 employs the LIGHT signal and the sampling clock waveform to generate an output if the fiber is opened and the HALT signal has not been received. In the halt or stand-by condition, the fiber monitoring circuitry 28 just tracks the condition of the fiber optics. In this stand-by condition, the fiber monitoring circuitry 28 also responds to the LIGHT signal to detect when the cable links have been reengaged and automatically re-arms the system by lowering the LFIBOPN line which is monitored by the halt circuitry 30 as shown in FIG. 2. In the normal operating mode, the monitoring circuitry 28 will latch in the fact that the fiber optics have been compromised. The output of the fiber monitoring circuit, LFIBOPN, is transmitted to the alarm circuitry 36 to generate a loud alarm.

The tamper detection circuitry 32 also receives the HALT signal and monitors the status of two switches S2 and S3. These switches, S2 and S3, are connected to two screws in the case which must be removed in order to access the electrical components. Thus, the tamper detection circuitry 32 prevents an intruder from gaining access to the electrical components without generating an alarm. In the event that the electrical components has been comprised, and the system is not in the stand-by condition, a signal TAMPER is generated and, like LFIBOPN, results in a loud alarm issuing from alarm component 36. The alarm component 36 also receives a signal LOWBAT from the low battery condition circuitry 24 when the voltage of the batteries drops below a predetermined level to produce a soft intermittent alarm. The softness of the alarm for halt or low battery conditions is controlled by resistor R23 in alarm circuitry 36. The period of the soft intermittent alarm is dependent upon the signal ASCKD, generated by the intermittent signal generator 42 shown in detail in FIG. 5. As shown by the schematic diagram the generator 42 permits the programming of a signal ASCKD of variable duration and frequency by choosing which of the switches S5-1 to S5-6 are in the closed position.

Figure 6:
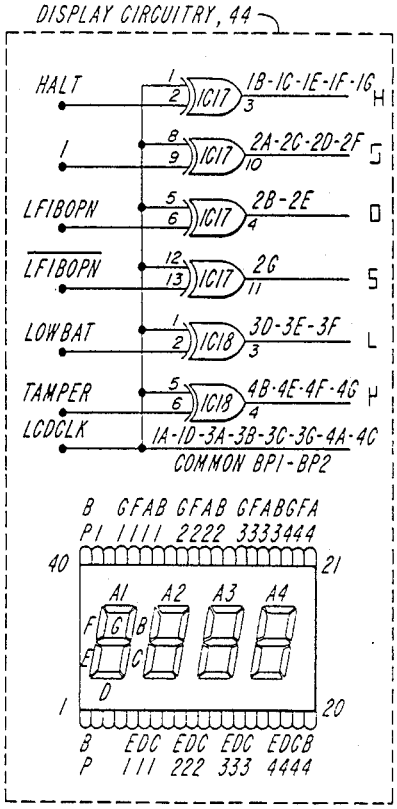
FIG. 6 is a detailed schematic diagram of the display circuitry for the controller of FIG. 1.
Figure 5:
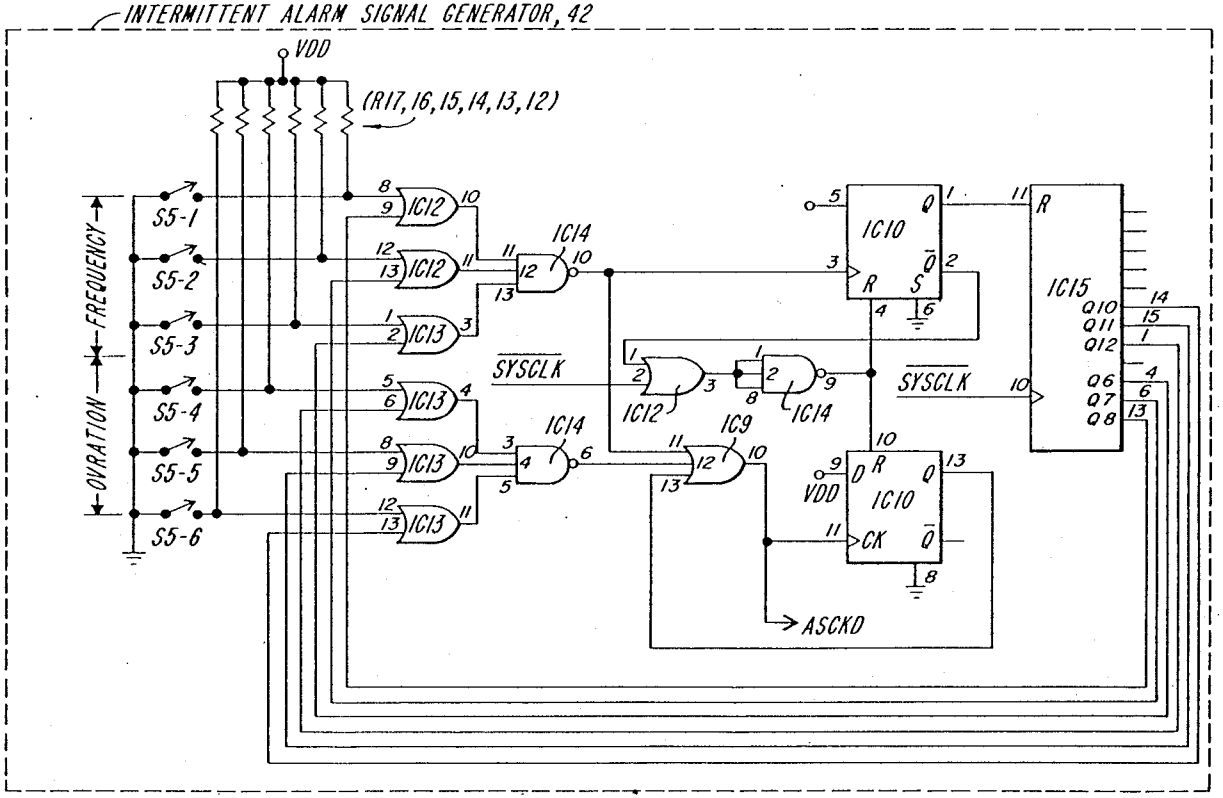
FIG. 5 is a detailed schematic diagram of the intermittent alarm signal circuitry for the controller of FIG. 1.

Finally, in FIG. 6 a visual display of the controller functions and conditions is provided by liquid crystal display circuitry 44. The inputs to the various pins of display component 44 are shown above it and the resulting display is shown adjacent to each input.

The components shown in the above-described schematic diagrams are further identified in Table I below.

TABLE I

PARTS LIST

| DESCRIPTION | REFERENCE NUMBER | QUANTITY |
|---|---|---|
| BUZZER FMB-12C 12v | BZ1 | 1 |
| CAP .01uF CER, MON 5% 50v | C1, C2, C3 | 3 |
| CAP 1.uF CER, MON 20% 50v | C7, C9 | 2 |
| CAP .1uF CER, MON 20% 50v | C8 | 1 |
| CAP 47uF TAN, RADIAL 20% 20v | C5, C6 | 2 |
| DIODE, Emitter 665nM SE-4355-002 | Q1 | 1 |

TABLE I-continued

PARTS LIST

| DESCRIPTION | REFERENCE NUMBER | QUANTITY |
|---|---|---|
| DIODE, Receiver 875nM SD4478-002 | Q4 | 1 |
| DIODE, Signal 100ma 80v IN4838 | D1, D3 | 2 |
| DIODE, Zener 2.4v 5% IN4370A | D2 | 1 |
| DISPLAY, LCD 4DIG 8SEG FE0202-D | LCD1 | 1 |
| IC 2904 OP AMP DUAL | IC3 | 1 |
| IC 4001 4 NOR2 | IC8, IC16 | 2 |
| IC 4011 4 NAND2 | IC7 | 1 |
| IC 4013 2FF D-TYPE PET PR CR | IC4, IC5, IC10 | 3 |
| IC 4020 1 COUNTER-14 NET CR | IC11, IC15 | 2 |
| IC 4023 3 NAND3 | IC14 | 1 |
| IC 4047 1 AS/MONOSTABLE | IC1 | 1 |
| IC 4070 4 XOR2 | IC17, IC18 | 2 |
| IC 4071 4 OR2 | IC6, IC12, IC13 | 3 |
| IC 4075 3 OR3 | IC9 | 1 |
| IC 4528 2 ONESHOT | IC2 | 1 |
| MOSFET VN2222 NCHANNEL 30v 1w | Q2, Q5, Q6, Q7 | 4 |
| MOSFET VP0300 PCHANNEL 30v 1w | Q3 | 1 |
| RES 10 CAR, FILM 10% 1/4w | R24 | 1 |
| RES 10000 CAR, FILM 10% 1/4W | R23 | 1 |
| RES 100000 CAR, FILM 5% 1/4w | R6 | 1 |
| RES 1000000 CAR FILM 10% 1/4w | R5 | 1 |
| RES 1000000 TRIM | R11 | 1 |
| RES 120 CAR, FILM 10% 1/4w | R21 | 1 |
| RES 156 MET, FILM 1% 1/4w | R22 | 1 |
| RES 18 CAR, FILM 10% 1/4w | R4 | 1 |
| RES 2700000 CAR, FILM 10% 1/4w | R7, R8, R9, R10, R12, R13, R14, R15, R16, R17, R18, R19 | 12 |
| RES 33000 CAR, FILM 5% 1/4w | R2 | 1 |
| RES 470000 CAR, FILM 5% 1/4w | R1 | 1 |
| RES 6800 CAR, FILM 5% 1/4w | R3 | 1 |
| RES 86.6 MET, FILM 1% 1/4w | R20 | 1 |
| SWITCH 3 POSITION DIP | SW4, SW5, SW6 | 3 |
| SWITCH KEY NC SPST | S1 | 1 |

I claim:

1. A system for securing articles, the system comprising an optically transmissive, flexible cable capable of attachment to said articles, said cable comprising:

a plurality of links; and a plurality of separable connectors, each connector joining two links together to permit optical transmissions therethrough;

a transmitter connected to said cable, for transmitting optical pulses into said cable;

a receiver connected to said cable for receiving the pulses from said transmitter after passage through said cable; and control means connected to the receiver for detecting perturbations in the received pulses and activating an indicator in response thereto; for allowing stand-by operation wherein the indicator is disabled while one or more connectors are separated for authorized purposes and for automatically re-arming the system when the connectors are re-engaged.

2. The system of claim 1 further including a photographic means and wherein the control circuitry includes a means for activating said photographic means in response to detected perturbations in the received pulses.

3. The system of claim 1 further including a portable battery and wherein the control circuitry includes means for activating an alarm in response to a low voltage condition in said battery.

4. The system of claim 3 wherein the system further comprises a second indicator which is triggered by said low battery condition.

5. The system of claim 1 wherein household voltage is used to power the transmitter, receiver and control circuitry.

6. The system of claim 1 wherein the transmitter is a light emitting diode, generating visible red light pulses.

7. The system of claim 1 wherein the transmitter is a laser diode.

8. The system of claim 1 wherein the cable is a plastic fiber having a peak transmissibility for light at about 600–700 nanometers in wavelength.

9. The system of claim 1 wherein the transmitter is connected to one end of said cable and the receiver is connected to the other end of said cable.

10. The system of claim 1 wherein the articles to be secured are items of merchandise.

11. The system of claim 1 wherein the articles to be secured are doors and windows.

12. The system of claim 1 wherein the system further comprises a second indicator which is triggered when the system has been disarmed.

13. The system of claim 1 wherein the system further comprises means for re-arming the control means following standby operation for a predetermined period of time.

14. A system for securing items of merchandise, the system comprising:

an optically transmissive, flexible fiber capable of attachment to said items and having a peak transmissibility for light at about 600–700 nanometers in wavelength, the fiber further comprising:

a plurality of links; and a plurality of separable connectors, each connector joining two links together to permit optical transmissions therethrough;

a portable battery;

a light emitting diode powered by said battery and connected to one end of said fiber for transmitting optical pulses into said fiber;

a receiver also powered by said battery and connected to the other end of said fiber for receiving the optical pulses from said light emitting diode after passage through said fiber; and control circuitry also powered by said battery and connected to the receiver for detecting perturbations in the received pulses and for activating an indicator in response thereto, for allowing stand-by operation wherein the indicator is disabled when one or more connectors are separated for authorized purposes, for automatically re-arming the system when the connectors are re-engaged, and for activating a second indicator in response to a low voltage condition in said battery.

15. The system of claim 14 wherein the system further comprises means for re-arming the control means following standby operation for a predetermined period of time.

16. A method for securing articles, the method comprising:

attaching an optically transmissive, flexible cable having a plurality of links and a plurality of connectors to said articles, the connectors permitting addition and removal of articles when disconnected and permitting optical transmissions through the cable when connected;

transmitting an optical pulse into said cable;

receiving the transmitted optical pulse after passage through said cable and generating an electrical signal in response thereto;

generating an indicator signal when the optical pulses are interrupted as a result of a connector being disconnected;

generating a stand-by signal which disables the indicator when authorized separation of connectors occurs; and reverting to normal operations after a predetermined period of time has elapsed in the stand-by condition.

17. The method of claim 16 wherein the method further includes employing a portable battery and generating a second indicator signal in response to a low voltage condition in the battery.

18. The method of claim 16 wherein the step of attaching an optically transmissive cable further comprises attaching a cable having a peak transmissibility for light at about 600–700 nanometers in wavelength.

19. The method of claim 16 wherein the step of transmitting an optical pulse into the cable further comprises transmitting a pulse of visible red light.

20. The method of claim 19 wherein the visible red light pulse is transmitted by a light emitting diode.

* * * * *